US007604369B2

(12) United States Patent
Tress et al.

(10) Patent No.: US 7,604,369 B2
(45) **Date of Patent: *Oct. 20, 2009**

(54) UNDER-CABINET LIGHTING SYSTEMS, KITS AND METHODS

(75) Inventors: Christopher M. Tress, Poland, OH (US); John J. Tress, Jr., Poland, OH (US)

(73) Assignee: Tresco International Ltd. Co., N. Lima, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/021,174

(22) Filed: Jan. 28, 2008

(65) Prior Publication Data

US 2008/0151532 A1 Jun. 26, 2008

Related U.S. Application Data

(62) Division of application No. 11/132,435, filed on May 19, 2005, now Pat. No. 7,384,166.

(51) Int. Cl.
*F21V 33/00* (2006.01)

(52) U.S. Cl. ..... 362/133; 362/391; 362/396

(58) Field of Classification Search ..... 362/127, 362/133, 249, 391, 396, 219, 250; 312/223.5; 248/229.26; 439/118, 532
See application file for complete search history.

(56) References Cited

U.S. PATENT DOCUMENTS

| | | | | |
|---|---|---|---|---|
| 3,065,334 | A | 11/1962 | Hillenbrand et al. | |
| 4,099,817 | A | 7/1978 | Booty | |
| 4,163,867 | A | 8/1979 | Breidenbach | |
| 4,689,726 | A | 8/1987 | Kretzschmar | |
| 4,861,273 | A | 8/1989 | Wenman et al. | |
| 4,943,900 | A | 7/1990 | Gartner | |
| 5,034,861 | A | 7/1991 | Sklenak et al. | |
| 5,040,104 | A | 8/1991 | Huisingh et al. | |
| 5,128,847 | A | 7/1992 | Lin et al. | |
| 5,233,773 | A * | 8/1993 | Reynolds | 40/661.03 |
| 5,249,112 | A | 9/1993 | Bray | |
| 5,336,100 | A | 8/1994 | Gabrius et al. | |

(Continued)

FOREIGN PATENT DOCUMENTS

| | | | |
|---|---|---|---|
| JP | 401276505 | A | 11/1989 |

(Continued)

*Primary Examiner*—Thomas M Sember
(74) *Attorney, Agent, or Firm*—Nixon & Vanderhye P.C.

(57) ABSTRACT

Under-cabinet lighting systems and methods include lighting fixtures are capable of being hidden from view by a decorative molding forming a part of the cabinetry. Such decorative molding also serves the dual purpose of a wiring raceway and a physical support for the lighting fixture. The lighting fixture includes a mounting clip which is especially adapted to be engaged removably with the wiring channel of the molding at a desired location along the length thereof. The mounting clip may be integrally provided with a component of the lighting fixture or may be provided as a separate structure which is removeably attached thereto. At the location of the lighting fixture the wiring may be extended into engagement with knife contacts of the fixture which pierce the insulation of the wiring and establish electrical contact with the bulb. In such a manner, hidden under-cabinet lighting fixtures may be provided which are relatively easy to install as a component part of the cabinetry.

13 Claims, 11 Drawing Sheets

U.S. PATENT DOCUMENTS 5,465,199 A 11/1995 Bray et al.
5,556,297 A 9/1996 Bray et al.
5,658,067 A 8/1997 Engle et al.
5,702,177 A 12/1997 Lin
5,733,139 A 3/1998 Bray et al.
5,772,315 A * 6/1998 Shen ..... 362/396
5,829,864 A 11/1998 Scanlan
6,089,884 A 7/2000 Klaus
6,109,765 A 8/2000 Blanton
6,190,198 B1 2/2001 Ray
6,283,608 B1 9/2001 Straat
6,676,281 B2 1/2004 Bray et al.
6,814,462 B1 11/2004 Fiene
6,929,503 B2 8/2005 Yu et al.
7,159,998 B2 1/2007 Moreland
2004/0174701 A1 9/2004 Fiene

FOREIGN PATENT DOCUMENTS

JP 405076424 A 3/1993

* cited by examiner

UNDER-CABINET LIGHTING SYSTEMS, KITS AND METHODS

CROSS REFERENCE TO RELATED APPLICATION

This application is a division of commonly owned U.S. application Ser. No. 11/132,435, filed on May 19, 2005 (now U.S. Pat. No. 7,384,166) which is hereby incorporated in its entirety by reference.

FIELD OF THE INVENTION

The present invention relates generally to under-cabinet lighting systems which provide task lighting to a work surface (e.g., countertops).

BACKGROUND AND SUMMARY OF THE INVENTION

Under-cabinet lighting is a well known and popular option for homeowners to provide task lighting directly onto countertops and like work surfaces. Under-cabinet lighting therefore minimizes shadowing of the task surface (e.g., countertops) that may otherwise occur if only overhead lighting systems were installed.

The art is replete with various proposals to provide lighting fixtures under cabinetry. For example, U.S. Pat. No. 5,829,864 to Scanlan describes a system having a decorative strip in which holes are provided for receiving lights. U.S. Pat. No. 6,089,884 to Klaus describes a classic track lighting system applied to the underside of the cabinetry in which lighting fixtures are connected to the electrical power by means of an electrically conductive track. U.S. Pat. No. 6,814,462 to Fiene discloses an under-cabinet lighting system wherein the wiring is routed to the fixtures by means of access holes drilled physically through the cabinet side panels.

While the proposals in the prior art are suitable for their intended purpose, improvements are still needed. For example, it would especially be desirable if under-cabinet lighting fixtures could be provided which are hidden from view by means of a decorative molding forming a part of the cabinetry. It would also be especially desirable if the decorative molding served the dual purpose of a wiring raceway and a physical support means for the lighting fixture. It is therefore towards fulfilling such needs that the present invention is directed.

Broadly, the present invention relates to under-cabinet lighting systems, kits and methods whereby under-cabinet lighting fixtures are capable of being hidden from view by means of a decorative molding forming a part of the cabinetry. Such decorative molding also serves the dual purpose of a wiring raceway and a physical support means for the lighting fixture. In especially preferred embodiments, the present invention is in the form of lighting systems, kits and methods which permit the tool-less mounting of undercabinet lighting fixtures to a decorative molding forming part of the cabinetry.

In especially preferred embodiments, the under-counter lighting systems of the present invention comprise an electrically non-conductive decorative molding (e.g., preferably formed of the same material as the cabinetry to which it is attached) and a lighting fixture. The decorative molding has a face that is decorative and a rear side which is provided with a longitudinally extending channel for receiving electrical wiring. The lighting fixture includes clips which are especially adapted to be engaged removably with the channel at a desired location along the length thereof.

According to one embodiment of the invention, at the location of the lighting fixture, the wiring may be extended into engagement with knife contacts of the fixture which pierce the insulation of the wiring and establish electrical contact with the bulb. In such a manner, hidden under-cabinet lighting fixtures may be provided which are relatively easy to install as a component part of the cabinetry.

According to another embodiment of the invention, the lighting fixture may include electrical connection terminals for receiving plug terminals of connection wiring. The connection wiring may thus be positioned in the channel of the decorative molding.

The fixture mounting clips adapted to be engaged removeably with the channel at a desired location along the length thereof may be formed as an integral component of the lighting fixture or may be removeably attached to the lighting fixture. Removable attachment of the mounting clips to the lighting fixture according to the present invention therefore allows a variety of conventional and commercially available lighting fixtures to be adapted for use as under cabinet lighting in association with the decorative molding.

A removable mounting clip is provided so as to removeably attach a lighting fixture to a wiring channel formed in a rear surface of decorative cabinet molding. According to a particularly preferred embodiment, the mounting clip comprises attachment means for attaching the mounting clip to the lighting fixture, and upper and lower engagement clip fingers projecting rearwardly of said attachment means and adapted to being removeably inserted into the wiring channel of the decorative cabinet molding.

The attachment means may be in the form of a base member of the lighting fixture wherein the upper and lower engagement clip fingers are integral with the base member or may be provided as a part of a separately removable mounting clip structure. If provided as a separate removable structure, the attachment means most preferably comprises upper and lower fixture mounting arms for removable engagement with the lighting fixture. The terminal ends of the upper and lower fixture mounting arms may include engagement claws adapted to be engaged with the lighting fixture. Such mounting claws preferably define a sloped lower surface to allow the engagement arms to resiliently spread when forced onto the lighting fixture during installation of the mounting clips thereto. In order to facilitate removal of the mounting clip from the lighting fixture, the engagement claw of the lower fixture mounting arm may define a slot to allow insertion of a removal tool.

According to another aspect of the invention, the mounting clip may be in the form of a one-piece (unitary) structure which comprises a clip wall, wherein the upper and lower engagement clip fingers are integrally joined to the clip wall and project rearwardly therefrom, and wherein the upper and lower fixture mounting arms are integrally joined to the clip wall and project forwardly therefrom.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
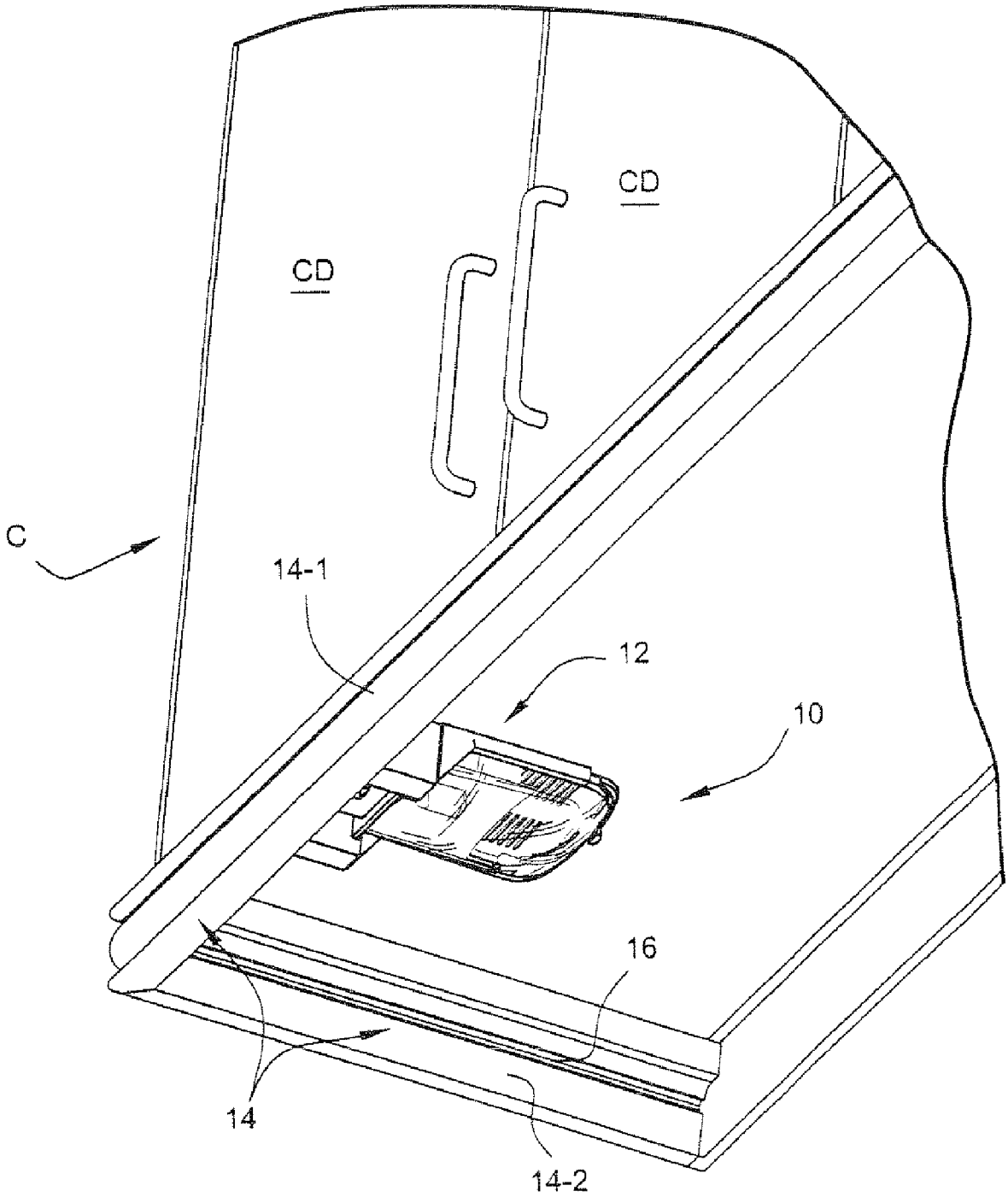
FIG. 1 is an underneath perspective view of cabinetry on which one preferred embodiment of an under-cabinet lighting system in accordance with the present invention has been installed.
Figure 2:
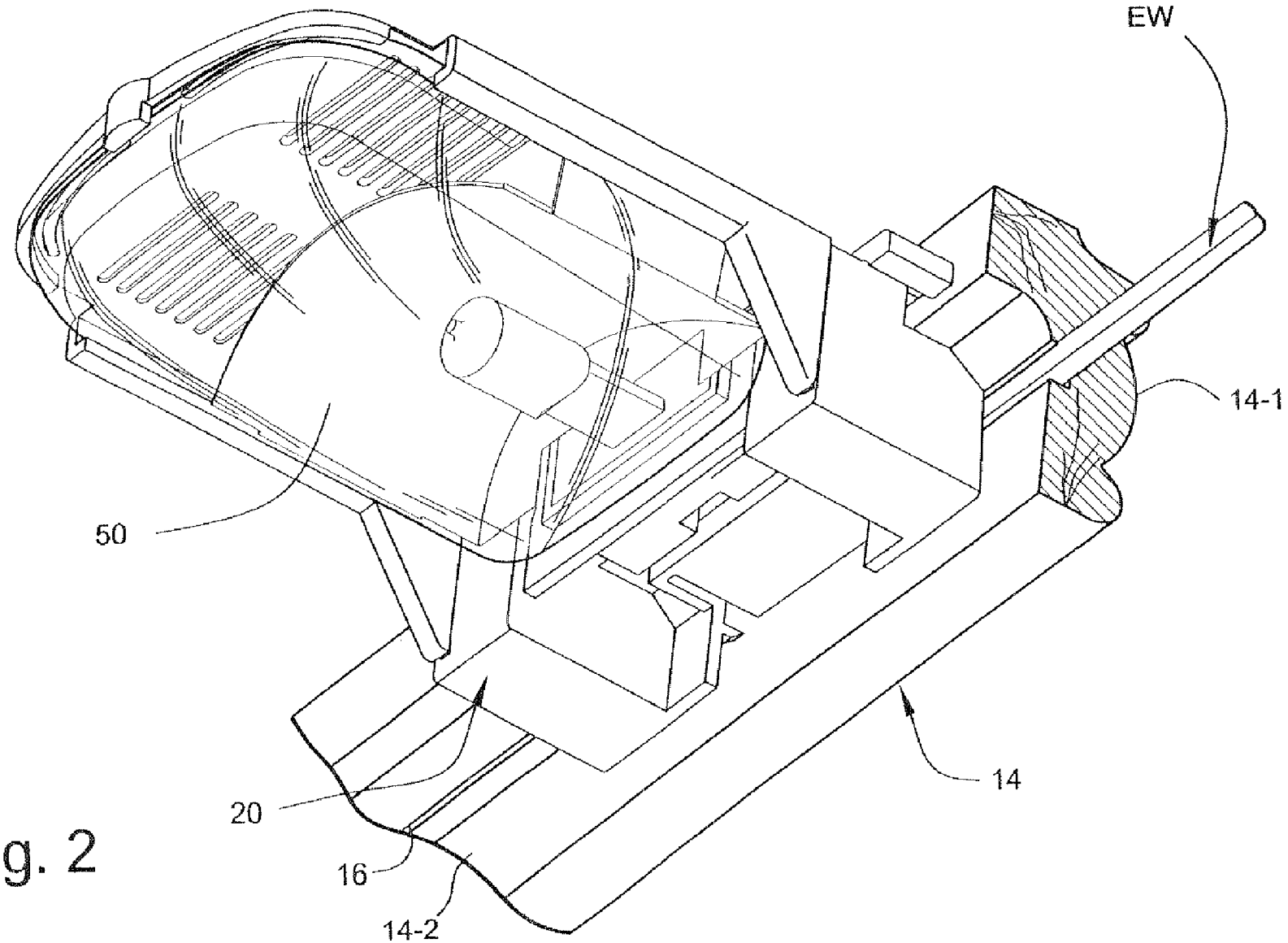
FIG. 2 is an underneath perspective view showing the lighting fixture depicted in FIG. 1 coupled operatively to the decorative molding.

A presently preferred embodiment of an under-cabinet lighting system 10 in accordance with the present invention is depicted in accompanying FIGS. 1 and 2. In this regard, the lighting system 10 is generally comprised of a lighting fixture 12 and a decorative molding 14 attached to the forward and side edges at the bottom of cabinetry C (see FIG. 1). The cabinetry is, in and of itself, conventional in that it is formed of a suitable cabinetry material (e.g., wood, composite laminates and/or molded plastics materials) with cabinetry doors CD which visibly hide internal storage shelves (not shown).

The decorative molding 14 is most preferably formed of the same material as the cabinetry C. As shown in FIG. 1, the decorative molding 14 has a visible face 14-1 that is decorative and a non-decorative rear surface 14-2 which is provided with a longitudinally extending channel 16 for receiving electrical wires EW. As will be explained in greater detail below, the lighting fixture 12 is physically attached to the channel 16 and electrically connected to a pair electrical wires EW positioned therewithin.

Figure 3:
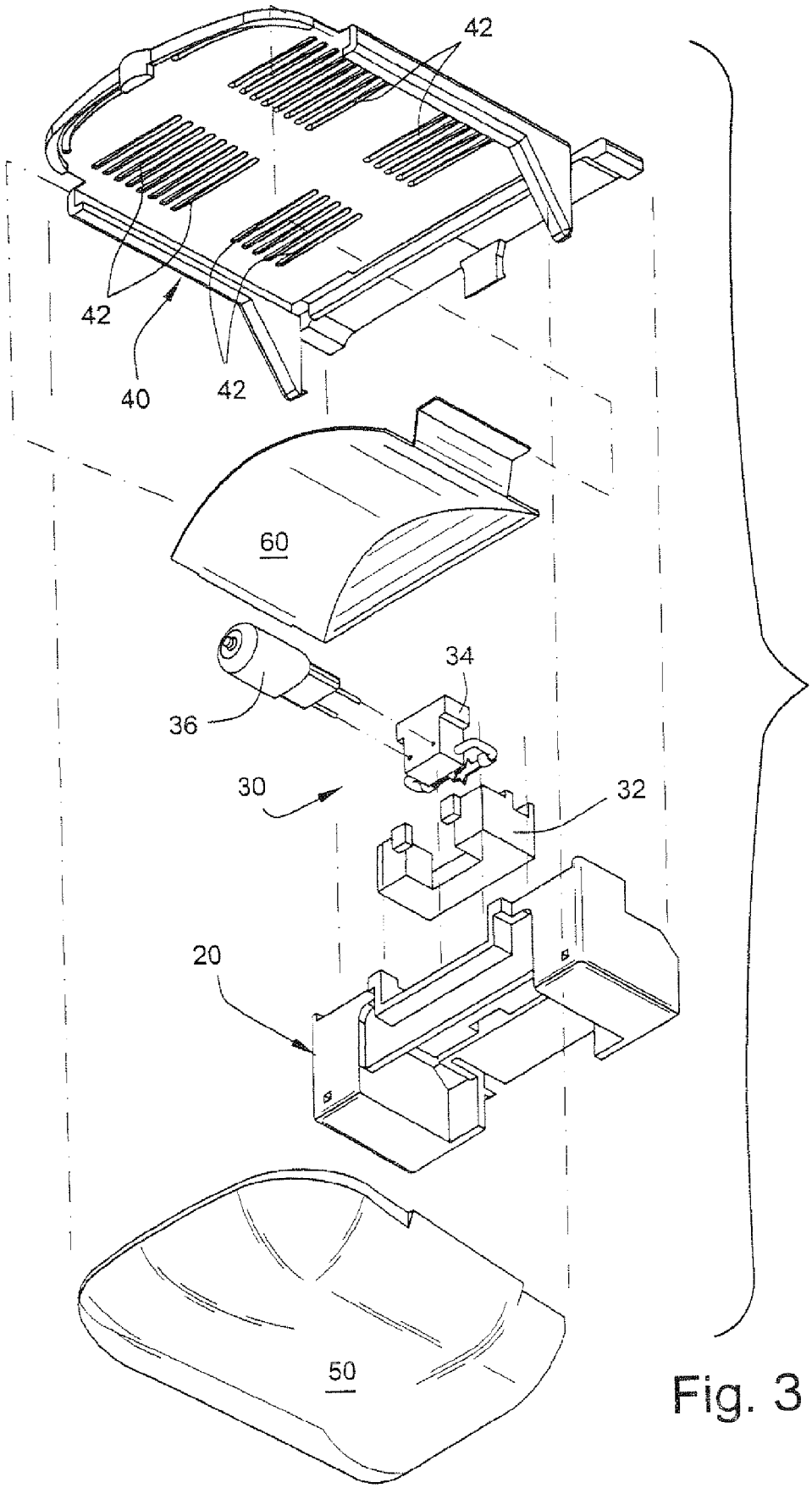
FIG. 3 is an exploded perspective view of one preferred embodiment of a lighting fixture according to the present invention.
Figure 4:
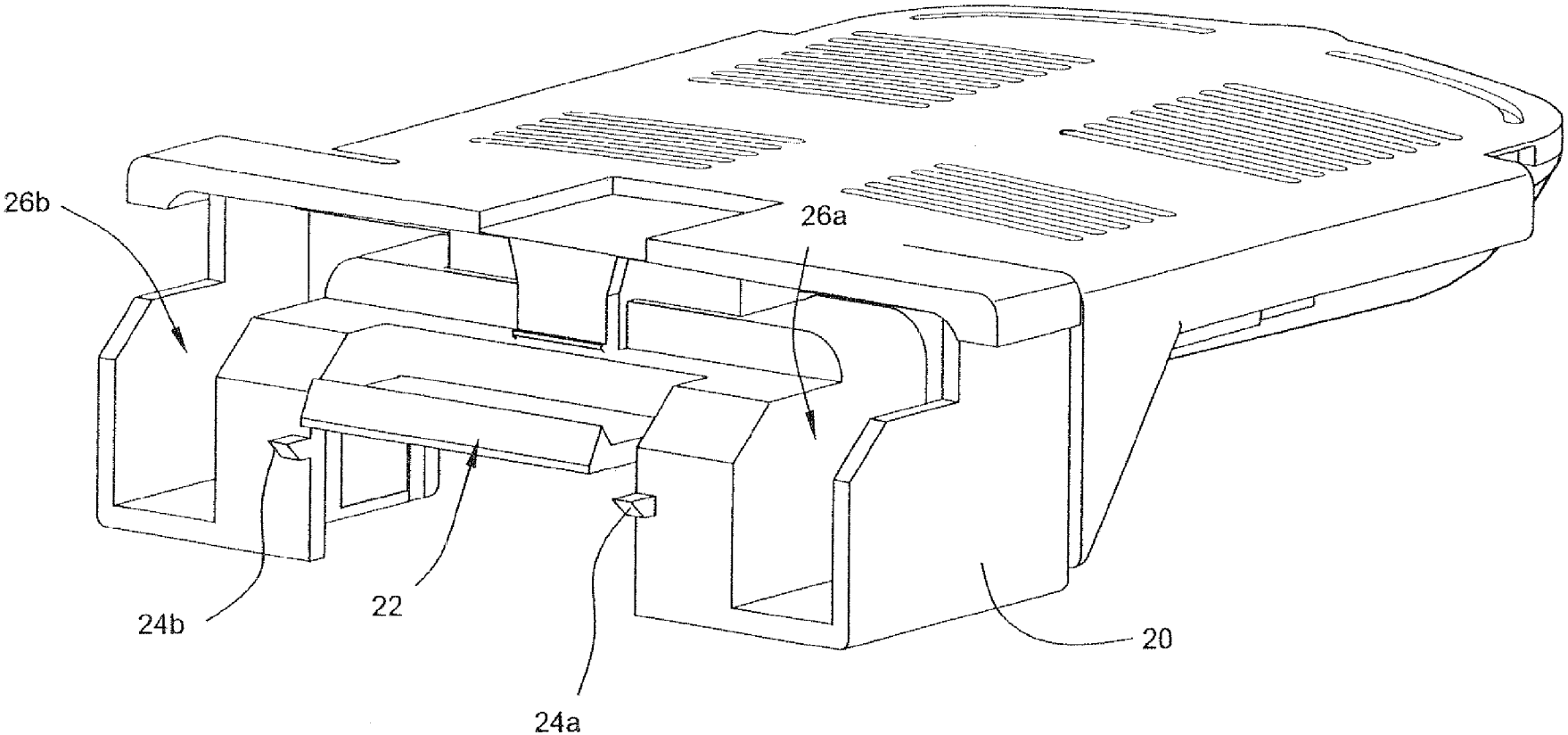
FIG. 4 is a rear perspective view of the lighting fixture according to the present invention depicted in FIG. 3.

The various component parts of the light fixture 10 in accordance with the present invention are depicted more clearly in the exploded view of accompanying FIG. 3 and the rear perspective view of accompanying FIG. 4. As shown, the light fixture 10 includes a base member 20 sized and configured to receive therein a bulb unit 30 which is itself comprised of a bulb base 32, an electrical contact unit 34 and a standard bulb 36. The base member 20 and bulb unit 30 are housed within an opaque low profile upper shell 40 and a lower transparent or translucent lens 50. A metal or metallized reflector 60 is positioned between the upper shell 40 and the bulb unit 30 so as to reflect light from the bulb 36 downwardly through the lens 50. The upper shell 40 includes a number of elongate vent slots 42 to allow heat generated by operation of the bulb 36 to escape to the ambient environment.

Figure 5A:
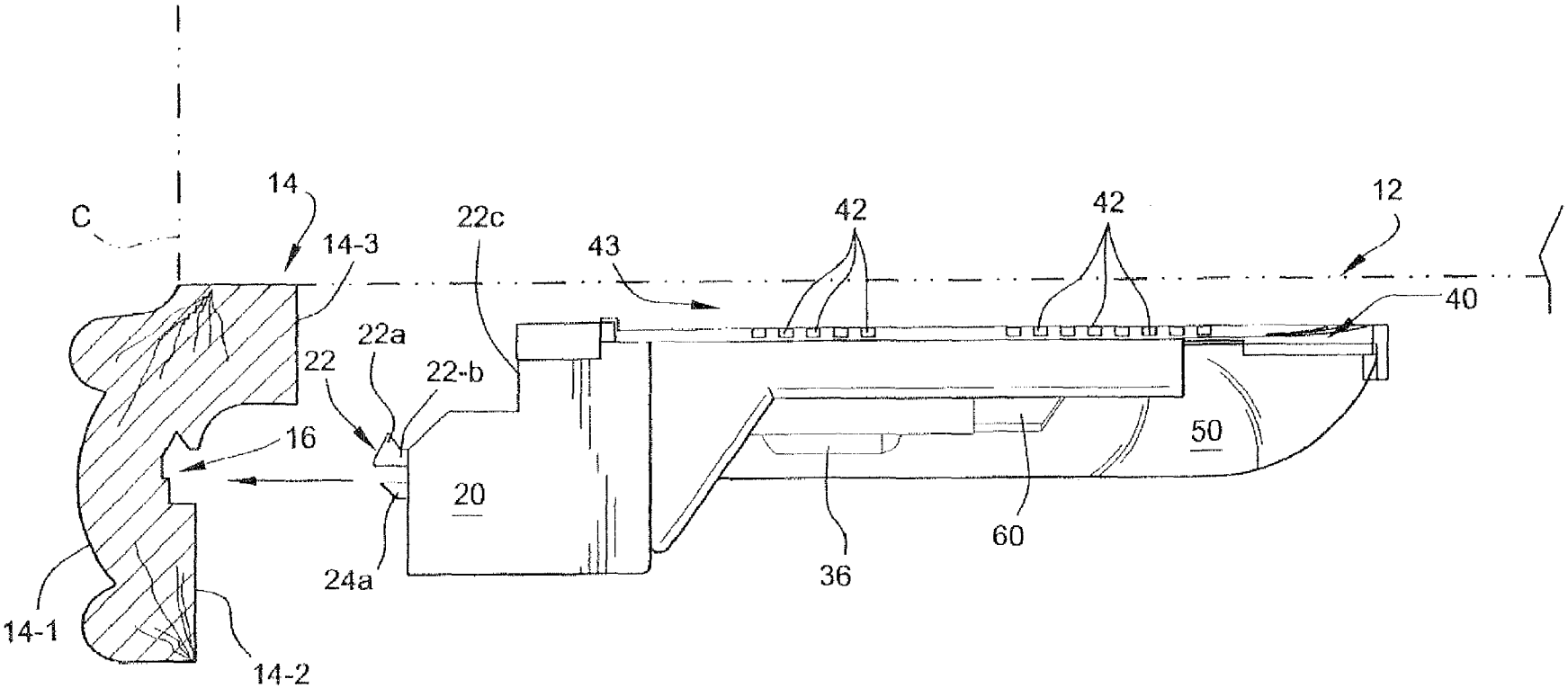
FIGS. 5A and 5B are each side elevation views showing the manner in which the lighting fixture of FIG. 3 may be coupled to the decorative molding.
Figure 5B:
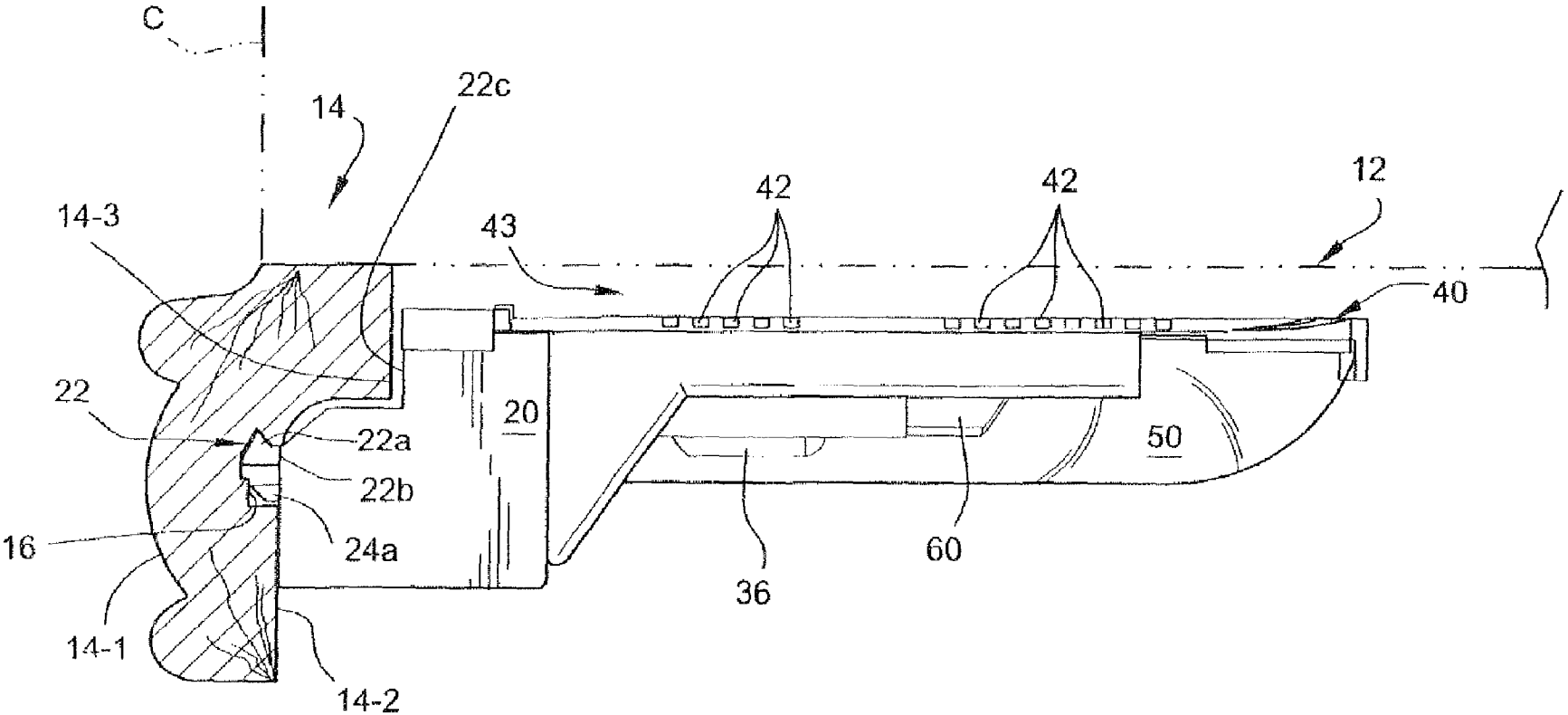

The base member 20 includes a mounting clip comprised of an elongate upper engagement clip finger 22 and a pair of laterally spaced-apart lower engagement clip fingers 24*a*, 24*b* extending rearwardly therefrom. As is seen in FIGS. 5A and 5B, the lower engagement clip fingers 24*a*, 24*b* are positioned below the upper engagement clip finger 22 as viewed in side elevation. In addition, the upper engagement clip finger 22 has a cross-sectional profile which is conformably shaped to an upper region of the channel 16, while the lower engagement clip fingers 24*a*, 24*b* are conformably shaped to a lower region of the channel 16. Collectively therefore, the upper and lower engagement clip fingers 22, 24*a*, 24*b* are capable of being inserted forcibly into the channel 16 so as to couple the lighting fixture 12 to the decorative molding 14. Moreover, the upper and lower engagement clip fingers 22, 24*a*, 24*b* will provide essentially a "three-point" cantilever support for lighting fixture 12 thereby ensuring that it is mounted stably to the molding 14.

As depicted in FIGS. 5A and 5B, the lighting fixture 12 may installed by simply forcibly inserting the upper engagement clip finger 22 and lower engagement fingers 24*a*, 24*b* into the conformably shaped channel 16 formed in the rear surface 14-2 of the decorative molding 14. In this regard, the upper clip finger 22 includes an enlarged head portion 22*a* and a relatively narrow neck portion 22*b* joining the head portion 22*a* integrally to the rear of the base member 20. The relatively narrow neck portion 22*b* and the plastics material from which it is formed (and preferably the plastics material from which the entirety of the base member 20, the upper engagement clip finger 22 and the lower clip fingers 24*a*, 24*b*, are formed) thereby provides a resilient connection to allow the head portion to be moved slightly during installation as will be discussed in greater detail below.

The base member 20 also includes an upper recessed shoulder 22*c* extending lengthwise in opposition to the rear surface 14-2 of the molding 14. The recessed shoulder 22*c* thereby is conformably shaped to the rearwardly projecting molding shoulder 14-3 formed on the molding 14. It will also be observed in FIGS. 5A and 5B that the upper shell 40 of the fixture 10 is separated from (i.e., is not flush with) the lower surface of the cabinetry C to thereby define a space 43 which allows heat to dissipate during fixture use.

It will of course be appreciated that, for clarity of presentation, the electrical wires EW are not visible in the channel 16 shown in FIGS. 5A and 5B. Instead, the manner in which the electrical wires EW are electrically connected to the lighting fixture 12 will be discussed in greater detail below with reference to accompanying FIGS. 6A and 6B.

In the preferred embodiment of the engagement clip finger 22 depicted in FIGS. 4, 5A and 5B, the head portion 22*a* thereof is triangularly shaped in cross-section so as to conform to the general triangular shape of the upper region of channel 16. Thus, as the head portion 22*a* is forced into the channel (i.e., in the direction of arrow A1 in FIG. 5A), the sloped surface of the head portion will serve as a cam of sorts to yieldably force the neck portion 22*b* downwardly to an extent whereby the entire head portion may be positioned within the channel 16. Once positioned within the channel 16, however, the resilient nature of the integral neck portion 22*b* will cause the head portion 22*a* to return to its normal state whereby it is seated within the conformably shaped upper portion of the channel 16 as shown in FIG. 5B. Meanwhile, the pair of engagement fingers 24*a*, 24*b* will be positioned in engagement with the lower portion of the channel 16.

The exact cross-sectional profile of the channel 16 and the upper engagement clip finger 22 is not critical. Thus, virtually any conceivable cross-sectional profiles thereof may be envisioned which permit secure but removable mating of the upper engagement clip finger 22 within the channel 16 so as to positionally mount the lighting fixture 12 to the decorative molding 14. Thus, the cross-sectional profiles of the channel 16 and engagement clip finger 22 may be embodied in uniform or nonuniform convexly curved profiles, L-shaped profiles, C-shaped profiles and the like, to name just a few. It will therefore be realized that the generally triangular cross-sectional profile of the channel 16 and engagement clip finger 22 as depicted in the accompanying drawings represent a presently preferred embodiment of the invention which is non-limiting with respect thereto.

Figure 6A:
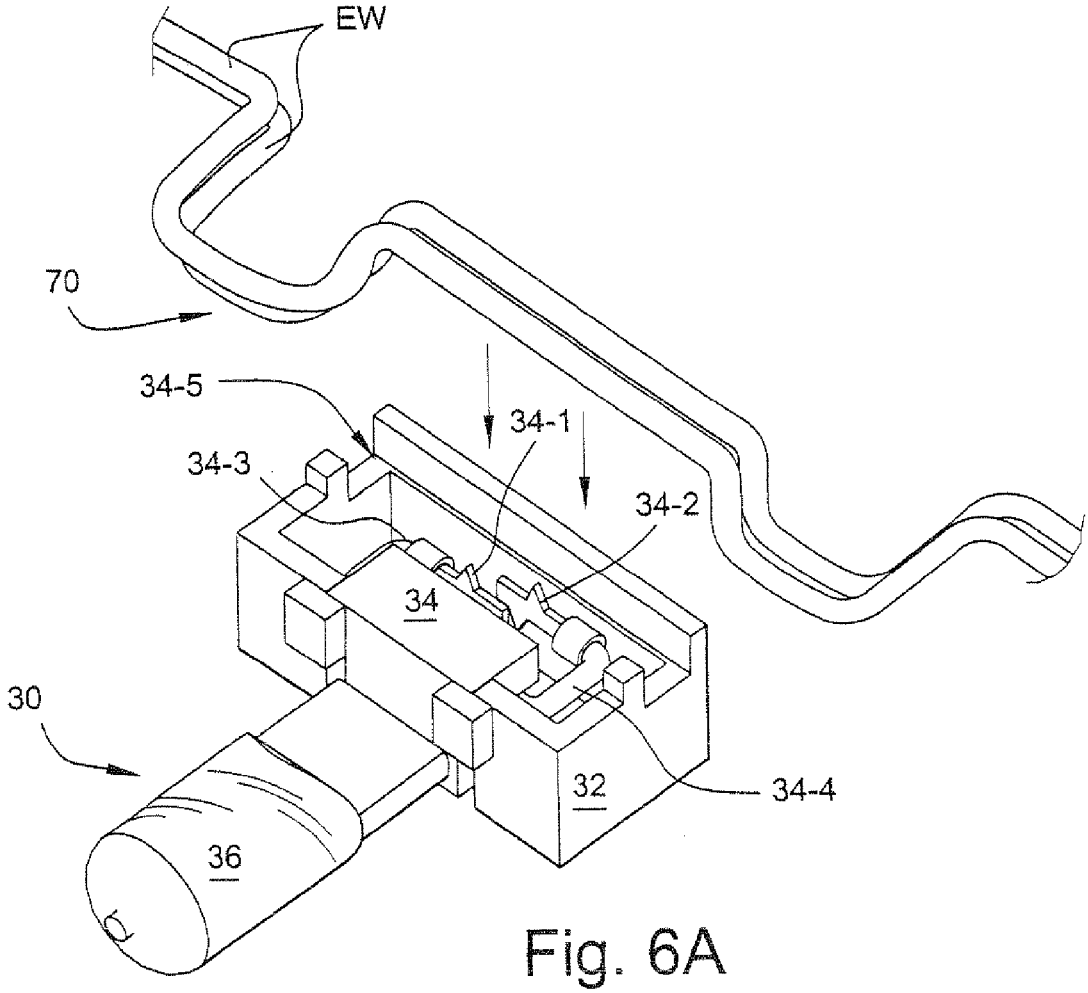
FIGS. 6A and 6B show the manner in which the bulb unit associated with the lighting fixture of FIG. 3 may be electrically connected to a pair of wires.
Figure 6B:
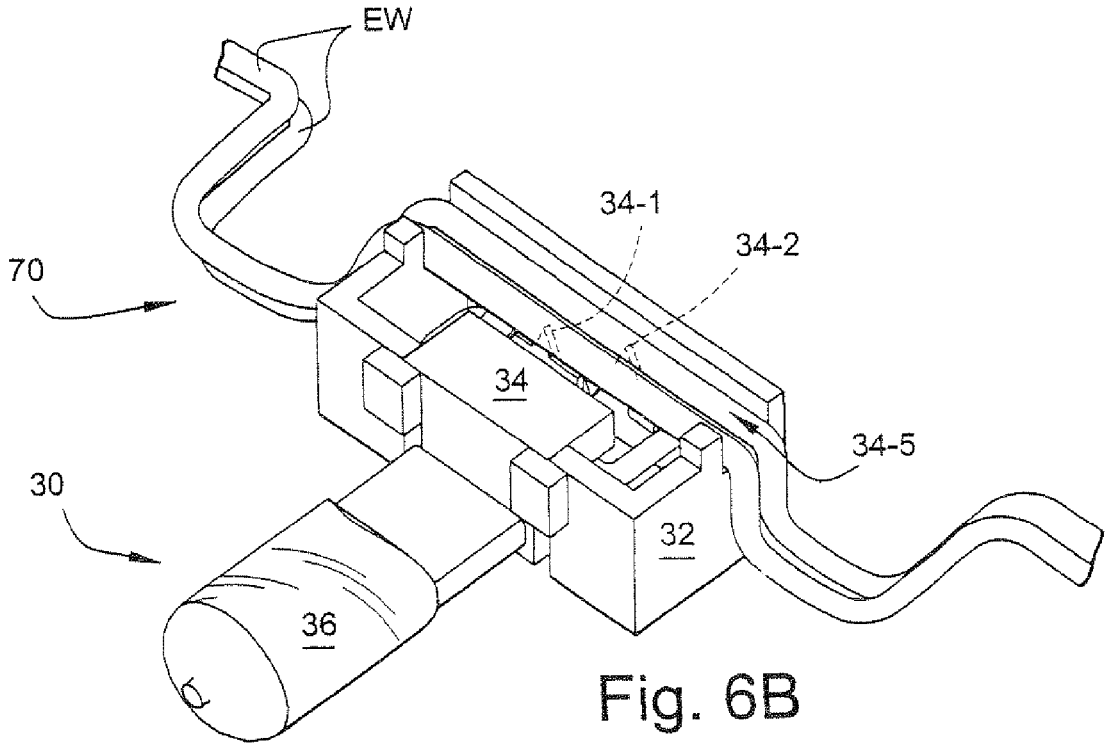

The manner in which electrical connection is established with the lighting fixture 12 of the present invention will be further understood by reference to FIGS. 6A and 6B. It will be appreciated in this regard that the electrical wires EW will be routed in the channel 16 from a main source of electrical energy (not shown), such as a transformer, junction box, and/or electrical distribution panel, as may be required by the particular installation. At each location where it is desired to install a lighting fixture 12 in accordance with the present invention, the electrician will form a generally U-shaped wiring loop 70 which will allow the electrical wires EW to enter the base member 22 via wiring access openings 26*a*, 26*b* (see FIG. 4).

It will be appreciated that forming the wiring loop 70 will create a lengthwise portion of the wiring channel 16 in which the electrical wires EW are not present. Moreover, it will be appreciated that such lengthwise portion is immediately adjacent the rear of the base member 20 at a desired installation location along the rear side 14-2 of the decorative molding 14. Thus, the electrical wires EW of the loop 70 will enter the base member 20 through the wiring access openings 26*a*, 26*b* laterally adjacent the terminal ends of the engagement clip finger 22. In such a manner, the electrical wires EW will not present an impediment to the engagement clip finger 22 being forced into engagement with the wiring channel 16 as described previously.

The electrical contact unit 34 includes a pair of knife contacts 34-1, 34-2 which are electrically connected to the bulb 36 via lead wires 34-3, 34-4, respectively, when it is operatively inserted into the unit 34. As can be seen from FIGS. 6A and 6B, a portion of the wiring loop 70 may be forced downwardly into a wire cradle 34-5 of the contact unit 34 so as to cause the knife contacts 34-1, 34-2 to pierce through the electrical insulation coating of the electrical wires EW and make contact with the electrically conductive wire thereof. In such a manner, electrical communication is established with the bulb 36 so it can be illuminated when the electrical wiring is energized (e.g., by means of a switch, not shown).

The systems of the present invention may take many forms. For example, according to one embodiment of the invention, a kit may be provided comprised of the lighting fixture 10 and the decorative molding 14 matching the cabinetry purchased by the consumer. Alternatively, the cabinetry C itself may be provided as part of the system kit along with the lighting fixture 10 and the molding 14. The molding 14 may be sold in nominal lengths for the contractor to cut on site, or may be in pre-cut lengths with appropriately mitered corners for the contractor to install onto the bottom edges of the cabinetry once the latter has been mounted. Thereafter, an electrician may route the electrical wiring 14 in the channel 16 and will provide a number of wiring loops 70 corresponding to the location along the length of the molding 14 where installation of fixture 10 is desired.

With the upper shell 40 removed from the base member 20, the electrician will thus place the wiring loop 70 within the wiring access openings 26*a*, 26*b* of the base member 20 and position the wires in the wiring cradle 34-5 of the contact unit 34 as described above so the electrical wires EW make electrical contact with the knife contacts 34-1, 34-2. Thereafter, the upper shell 40 may simply be snapped into engagement with the base member 20. The entire fixture 10 now electrically connected to the electrical wiring EW may thus be mounted to the molding 14 by forcibly inserting the engagement clip finger 22 and engagement fingers 24*a*, 24*b* as described previously.

Figure 7:
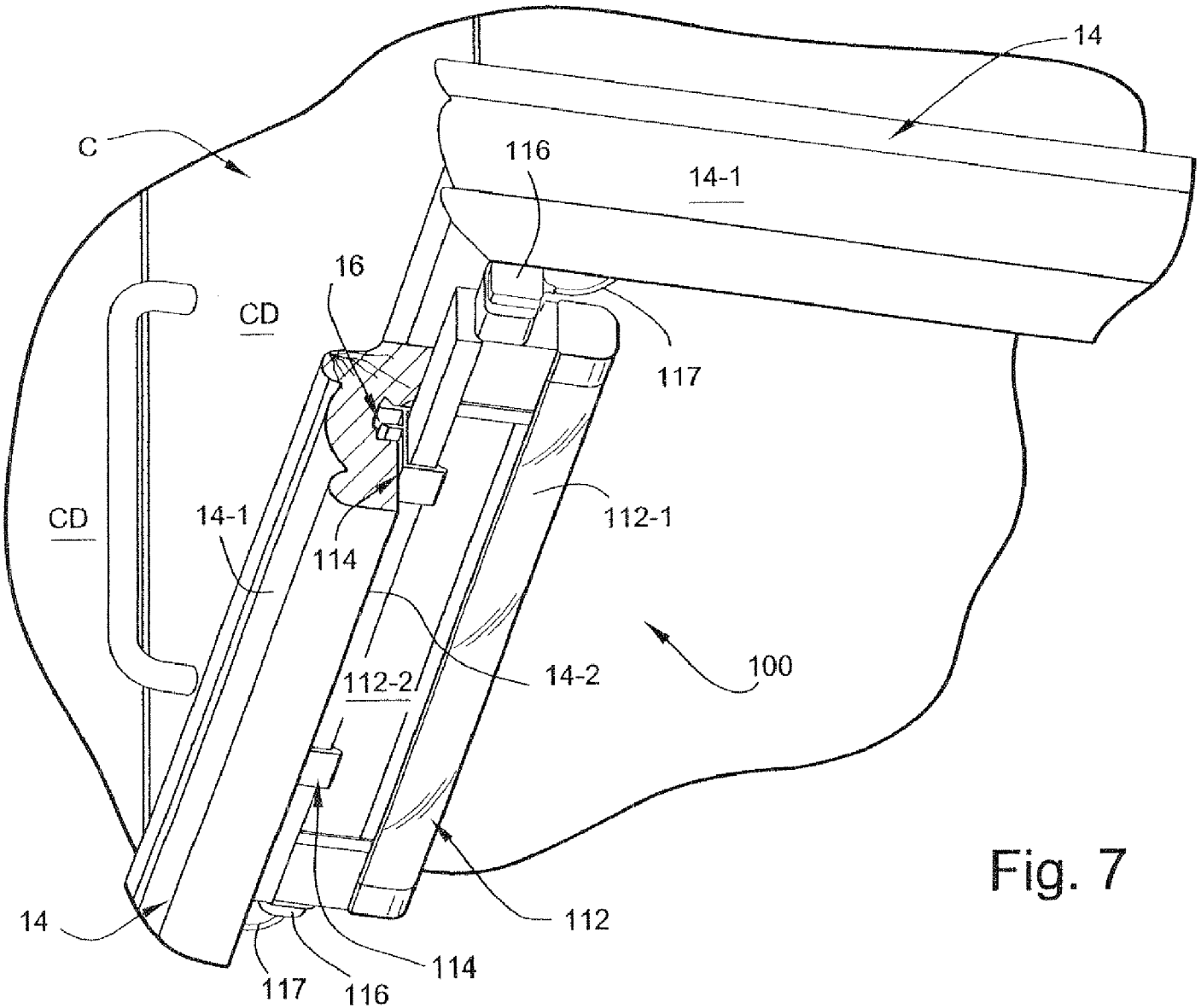
FIG. 7 is an underneath perspective view of cabinetry on which another preferred embodiment of an under-cabinet lighting system in accordance with the present invention has been installed.
Figure 8:
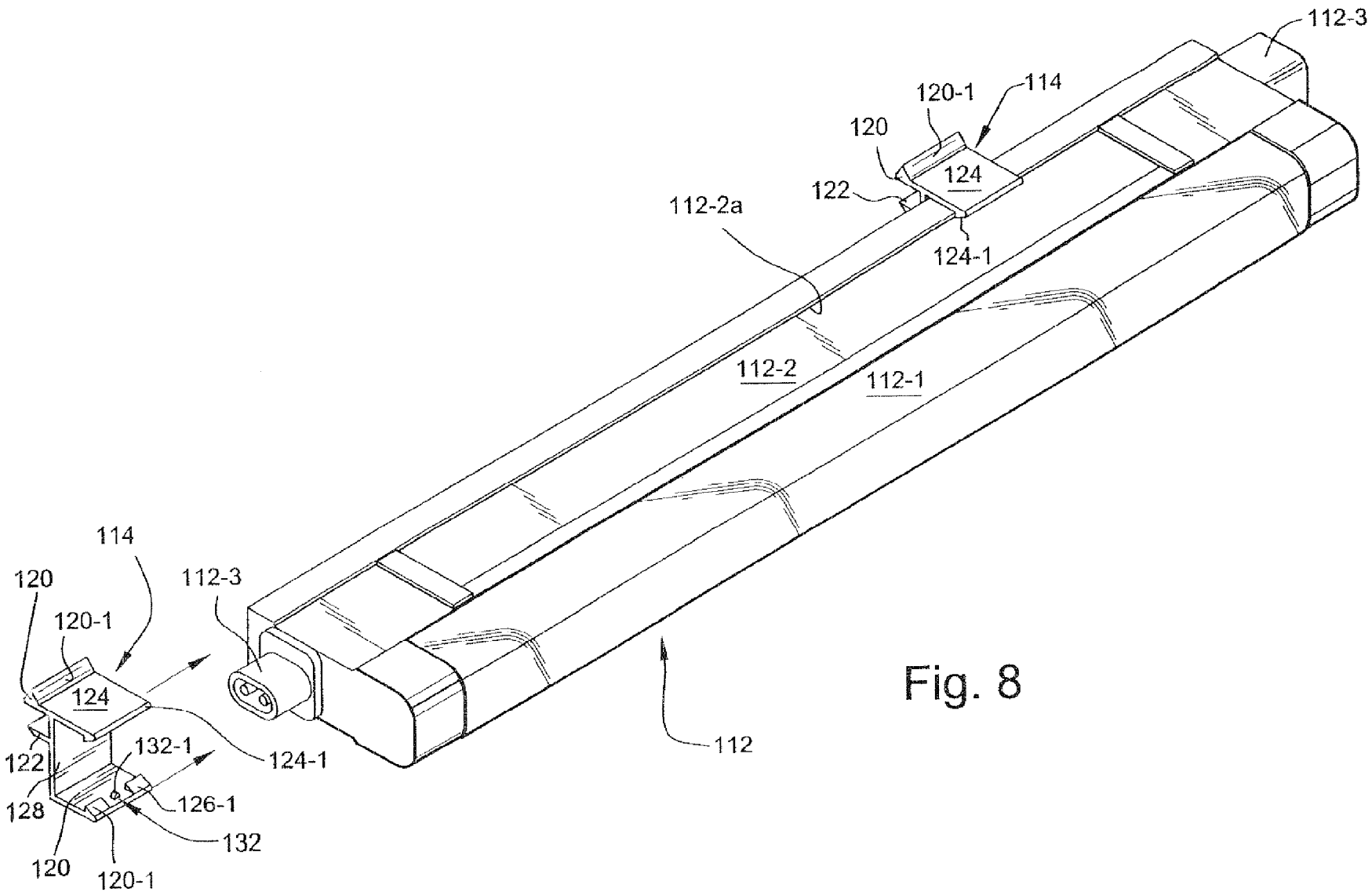
FIG. 8 is an enlarged top perspective view of the lighting fixture depicted in FIG. 7 together with removable mounting clips to attach the fixture to the decorative molding.
Figure 9:
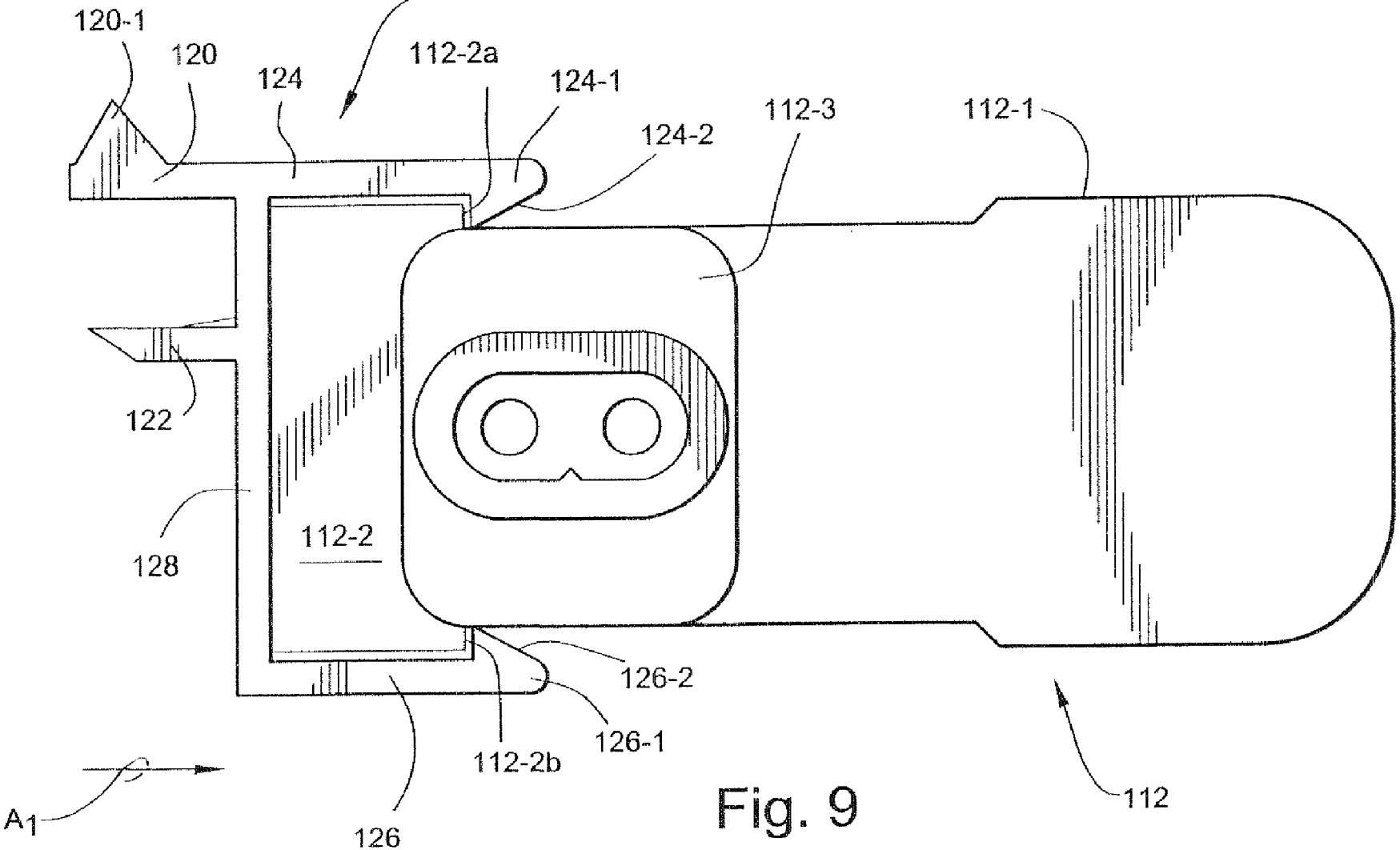
FIG. 9 is an enlarged end elevational view of the lighting fixture and mounting clips depicted in FIG. 8.

Another preferred embodiment of an under-cabinet lighting system 100 in accordance with the present invention is depicted in accompanying FIGS. 7-9. In this regard, the lighting system 100 is generally comprised of a lighting fixture 112 in combination with the decorative molding 14 which was described previously as being attached to the forward and side edges at the bottom of cabinetry C. In this regard, the lighting fixture 112 is depicted as being of a type having an elongate transparent or translucent lens 112-1 which covers a conventional fluorescent tube lamp (not shown), and a generally rectangular base 112-2 which houses the fixture's circuitry. Electrical plugs 116 are attached to respective receptacles 112-3 of the fixture so as to supply electrical energy thereto via wires 117 and to allow the fixture 112 to be interconnected in series with other similar fixtures. A pair of fixture mounting clips 114 is removeably attached to the base 112-2 so as to mount the fixture 112 to the rear surface 14-2 of the decorative molding 14 in a manner to be described further below.

As is perhaps best shown in FIG. 9, the mounting clips 114 according to the present invention include rearwardly projecting upper and lower clip fingers 120, 122 and forwardly projecting fixture mounting arms 124, 126 each attached to a clip wall 128. The clip fingers 120, 122 are vertically separated from one another by a distance essentially corresponding to the widthwise vertical dimension of the channel 16 formed in the decorative molding 14. The fixture mounting arms 124, 126 are similarly vertically separated from one another by a dimension to allow the base 112-2 of the fixture 112 to be received therebetween.

The upper clip finger 120 includes an enlarged generally triangular head portion 120-1 which is conformably shaped to an upper region of the cross-sectional profile of the channel 16. As discussed previously, however, the enlarged head portion 120-1 may take virtually any geometric shape in conformance to the particular cross-sectional profile that may be selected for the channel 16. The lower clip finger 122 on the other hand is conformably shaped to a lower region of the channel 16. Collectively therefore, the upper and lower clip fingers 120, 122 are capable of being inserted forcibly into the channel 16 so as to couple the lighting fixture 112 to the decorative molding 14. Moreover, the upper and lower clip fingers 120, 122 and the clip wail 128 will provide essentially a "three-point" cantilever support for lighting fixture 112 thereby ensuring that it is mounted stably to the molding 14. That is, the fingers 120, 122 will each engage respective upper and lower regions of the channel 16 while the clip wall 128 will bear against the rear surface 14-2 of the decorative molding 14.

The fixture mounting arms 124, 126 each terminate in an engagement claw 124-1, 126-1 adapted to engage with upper and lower raised shoulders 112-2*a*, 112-2*b*, respectively of the fixture base 112-2. In addition, the engagement claws 124-1, 126-1 each include a sloped lower surface 124-2, 126-2 which serves as a cam of sorts to allow the arms 124, 126 to spread slightly when forced onto the base 112-2 of the fixture 112 during installation of the mounting clips 114 thereto (i.e., when forced in a direction of arrow $A_1$ in FIG. 9). The resilient nature of the mounting arms 124, 126 will therefore allow them to return to a normal condition once the base 112-2 of the fixture 112 has been received therebetween so that the claws 124-1 and 126-1 thereof engage with the shoulders **112-*a* and 112-2*b***, respectively.

Figure 11:
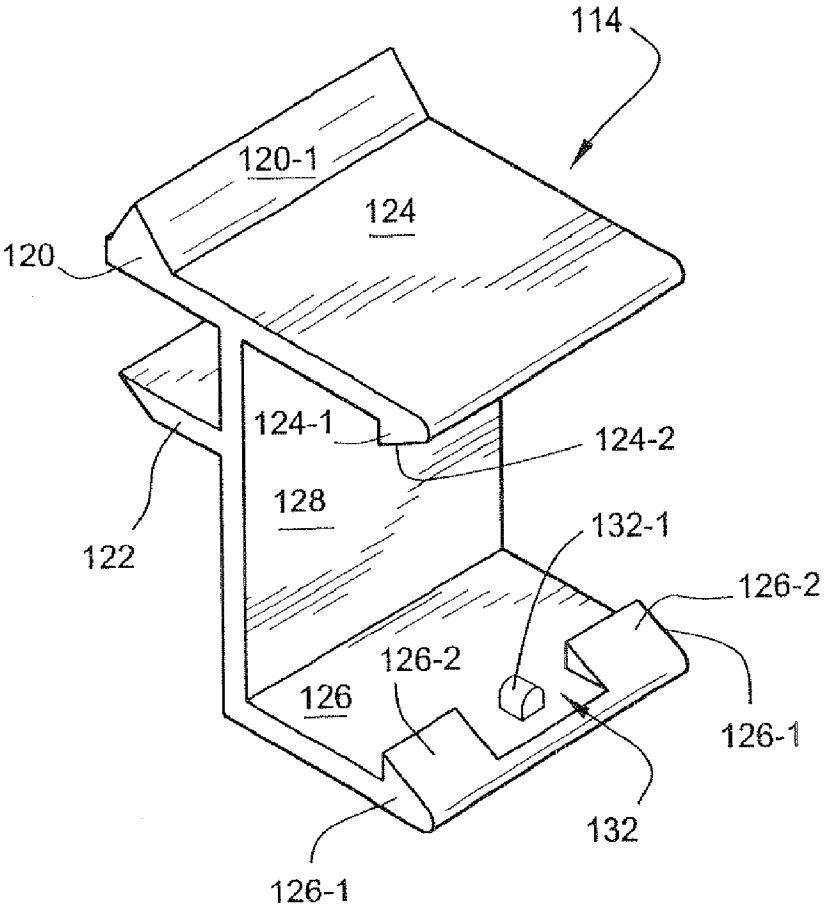
FIGS. 10 and 11 are respectively rear and front perspective views of a preferred fixture mounting clips of the present invention.
Figure 10:
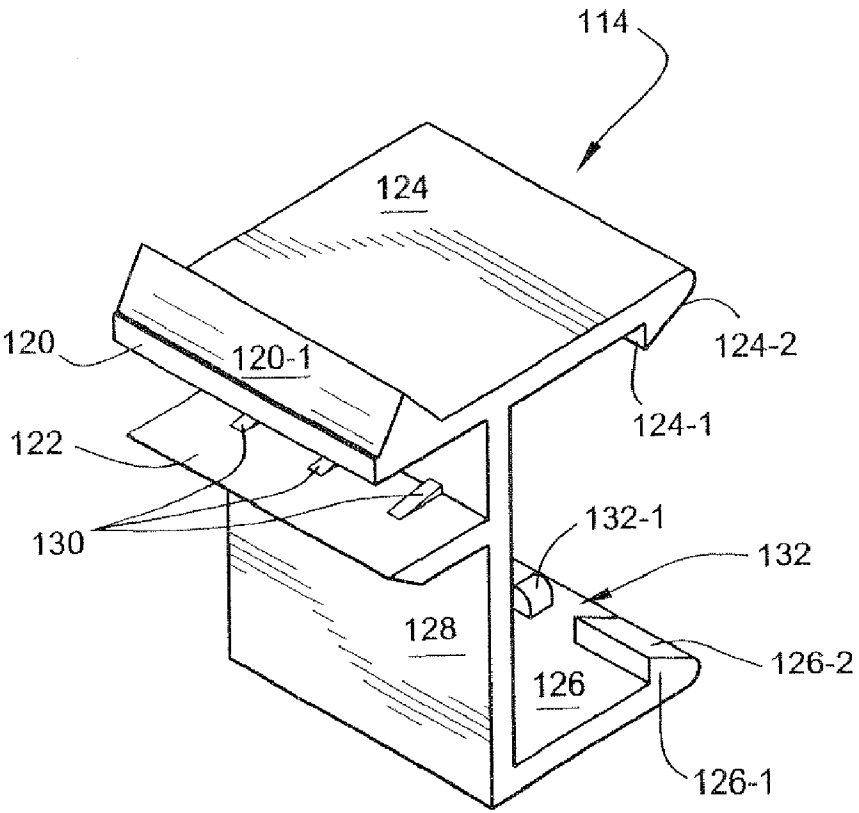

As is particularly shown in FIGS. 10-11, the preferred mounting clip 114 is most preferably a unitary (one-piece) structure molded from a resilient plastics material. In this regard, a number of raised ribs 130 may be provided so as to structurally strengthen the clip fingers 120 and/or 122 (it being understood that only the ribs 130 associated with finger 122 are visible in FIG. 10). In addition, a recessed window 132 is formed in the claw 126-1 of the lower mounting arm 126 so as to allow a tool (e.g., a flat-bladed screw driver) to be inserted to assist in spreading the mounting arm 126 and thereby permit the fixture 112 to be removed from the clip 114. An integrally molded raised stop surface 132-1 is provided so as to prevent over-insertion of the tool in the window 132.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of installing a lighting fixture under a cabinet comprising the steps of:

(a) installing a decorative molding along a bottom edge of a cabinet, the molding having a decorative front face which exhibits decorative conformity to the cabinet and a rear side opposite the front face and having a lengthwise extending wiring channel formed in the rear side thereof which is adapted to receive electrical wires;

(b) installing electrical wires in the wiring channel of the decorative molding and forming at least one wiring loop at an installation location of the lighting fixture;

(c) establishing electrical connection between the electrical wires of the wiring loop with a contact unit of the lighting fixture;

(d) removeably attaching a mounting clip to the base member of a lighting fixture so that the mounting clip projects rearwardly from a base member of the lighting fixture; and (e) mounting the lighting fixture to the rear side of the decorative molding underneath the cabinet at the installation location by forcibly inserting the mounting clip projecting rearwardly from the base member into the wiring channel at the installation location.

2. A mounting clip for removeably mounting a lighting fixture to a wiring channel formed in a rear surface of decorative cabinet molding, the lighting fixture having a generally rectangular base and a lens covering the base, wherein the mounting clip comprises:

upper and lower fixture mounting arms separated from one another by a dimension to accommodate the base of the lighting fixture for removable engagement with the lighting fixture so as to allow removable attachment of the mounting clip to the lighting fixture, and upper and lower engagement clip fingers projecting rearwardly of the mounting arms and adapted to being removeably inserted into the wiring channel of the decorative cabinet molding, wherein each of the upper and lower fixture mounting arms includes respective upper and lower engagement claws for engagement with raised shoulders of the lighting fixture, the engagement claws having sloped lower surfaces to allow the mounting arms to spread resiliently in response to the engagement claws being forced onto the rectangular base of the lighting fixture.

3. The mounting clip of claim 2, wherein the upper engagement clip finger includes an enlarged head portion which is adapted to being received within a conformably shaped upper portion of the wiring channel.

4. The mounting clip of claim 3, wherein the enlarged head portion has a substantially triangular cross-section.

5. The mounting clip of claim 2, wherein the engagement claw of the lower fixture mounting arm defines a slot to allow insertion of a removal tool.

6. The mounting clip of claim 2, comprising a clip wall, wherein said upper and lower engagement clip fingers are integrally joined to the clip wall and project rearwardly therefrom, and wherein the upper and lower fixture mounting arms are integrally joined to the clip wall and project forwardly therefrom.

7. The mounting clip of claim 5, wherein engagement claw of the lower fixture mounting arm includes a raised stop surface positioned in the slot.

8. An under-cabinet lighting kit adapted to being attached to a decorative molding associated with cabinetry, the lighting system comprising:

an elongate lighting fixture having a generally rectangular base; and at least one for mounting clip for removable attachment to the base of the lighting fixture and adapted to removeably mount the lighting fixture to a wiring channel associated with the decorative molding, wherein the mounting clip is comprised of upper and lower fixture mounting arms having engagement claws at terminal ends thereof for removable engagement with the base of the lighting fixture, and upper and lower engagement clip fingers projecting rearwardly of the mounting arms for insertion into the wiring channel of the decorative molding, and wherein the engagement claw of the lower mounting arm includes a slot defined therein for insertion of a removal tool.

9. The kit of claim 8, wherein the upper engagement clip finger includes an enlarged head portion which is adapted to being received within a conformably shaped upper portion of the wiring channel.

10. The kit of claim 9, wherein the enlarged head portion has a substantially triangular cross-section.

11. The kit of claim 8, wherein the engagement claws include a sloped lower surface to allow the engagement arms to resiliently spread when forced onto the lighting fixture during installation of the mounting clips thereto.

12. The kit of claim 8, comprising a clip wall, wherein said upper and lower engagement clip fingers are integrally joined to the clip wall and project rearwardly therefrom, and wherein the upper and lower fixture mounting arms are integrally joined to the clip wall and project forwardly therefrom.

13. The kit of claim 8, wherein the engagement claw of the lower fixture mounting arm further includes a raised stop surface positioned in the slot.

* * * * *